US011118582B2

(12) United States Patent
Reeves et al.

(10) Patent No.: US 11,118,582 B2
(45) Date of Patent: Sep. 14, 2021

(54) LINEAR HYDRAULIC PUMP FOR SUBMERSIBLE APPLICATIONS

(71) Applicant: GE Oil & Gas ESP, Inc., Oklahoma City, OK (US)

(72) Inventors: Brian Reeves, Edmond, OK (US); Charles Collins, Oklahoma City, OK (US); Aaron Noakes, Oklahoma City, OK (US); Eric Rohlman, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 0 days.

(21) Appl. No.: 16/458,027

(22) Filed: Jun. 29, 2019

(65) Prior Publication Data

US 2019/0323499 A1 Oct. 24, 2019

Related U.S. Application Data

(62) Division of application No. 14/982,936, filed on Dec. 29, 2015, now abandoned.

(51) Int. Cl.

| | |
|---|---|
| ***F04C 15/00*** | (2006.01) |
| ***F04B 9/10*** | (2006.01) |
| ***F04B 23/10*** | (2006.01) |
| ***F04B 53/14*** | (2006.01) |
| ***E21B 43/12*** | (2006.01) |
| ***F04B 47/06*** | (2006.01) |

(Continued)

(52) U.S. Cl.

CPC ..... *F04C 15/008* (2013.01); *E21B 43/128* (2013.01); *F04B 1/14* (2013.01); *F04B 1/143* (2013.01); *F04B 1/146* (2013.01); *F04B 1/16* (2013.01); *F04B 9/10* (2013.01); *F04B 23/106* (2013.01); *F04B 23/12* (2013.01); *F04B 47/02* (2013.01); *F04B 47/04* (2013.01); *F04B 47/06* (2013.01); *F04B 53/14* (2013.01); *F04C 13/008* (2013.01)

(58) Field of Classification Search

None

See application file for complete search history.

(56) References Cited

U.S. PATENT DOCUMENTS 2,431,492 A 11/1947 Lewis
2,435,179 A 1/1948 Carl
(Continued)

FOREIGN PATENT DOCUMENTS

EP 2383432 A1 11/2011
EP 2543812 A1 1/2013
(Continued)

*Primary Examiner* — Peter J Bertheaud
*Assistant Examiner* — Geoffrey S Lee
(74) *Attorney, Agent, or Firm* — Crowe & Dunlevy, P.C.

(57) ABSTRACT

A submersible pumping system has an electric motor, a rotary hydraulic pump driven by the electric motor, and a linear hydraulic pump that is configured to move a production fluid. The rotary hydraulic pump produces a pressurized working fluid that drives the linear hydraulic pump. In another aspect, a method is disclosed for controlling the temperature of an electric motor within a submersible pumping system disposed in a wellbore. The method includes the steps of circulating motor lubricant through a hydraulically driven production pump to reduce the temperature of the motor lubricant.

10 Claims, 9 Drawing Sheets

(51) Int. Cl.

| | |
|---|---|
| ***F04C 13/00*** | (2006.01) |
| ***F04B 23/12*** | (2006.01) |
| ***F04B 1/146*** | (2020.01) |
| ***F04B 1/143*** | (2020.01) |
| ***F04B 1/14*** | (2020.01) |
| ***F04B 1/16*** | (2006.01) |
| ***F04B 47/04*** | (2006.01) |
| ***F04B 47/02*** | (2006.01) |

(56) References Cited

U.S. PATENT DOCUMENTS

| | | | | |
|---|---|---|---|---|
| 2,455,022 | A * | 11/1948 | Schmidt | F04B 47/06 417/99 |
| 2,457,339 | A | 12/1948 | Alex | |
| 2,489,505 | A * | 11/1949 | Schmidt | F03C 1/0536 417/339 |
| 2,606,500 | A | 8/1952 | Schmidt | |
| 2,690,224 | A | 9/1954 | Roberts | |
| 2,770,099 | A | 11/1956 | Giovanni | |
| 2,972,955 | A | 2/1961 | Harald et al. | |
| 3,160,110 | A | 12/1964 | Tadeusz | |
| 3,171,630 | A | 3/1965 | Harney et al. | |
| 3,172,630 | A | 3/1965 | Goodman | |
| 3,253,551 | A | 5/1966 | Hans | |
| 3,292,715 | A | 12/1966 | Balogh | |
| 3,380,392 | A | 4/1968 | Boers | |
| 3,420,059 | A | 1/1969 | Wagenen et al. | |
| 3,587,404 | A | 6/1971 | Kratzenberg | |
| 3,600,109 | A | 8/1971 | Pavlichenko et al. | |
| 3,643,434 | A | 2/1972 | Widmaier | |
| 4,212,596 | A | 7/1980 | Ruseff | |
| 4,285,401 | A | 8/1981 | Erickson | |
| 4,372,389 | A | 2/1983 | Hamrick et al. | |
| 4,388,808 | A | 6/1983 | Durenec | |
| 4,444,444 | A | 4/1984 | Benedetti et al. | |
| 4,444,445 | A | 4/1984 | Davies et al. | |
| 4,770,084 | A | 9/1988 | Miwa et al. | |
| 5,176,066 | A | 1/1993 | Kanamaru et al. | |
| 5,602,059 | A | 2/1997 | Horiuchi et al. | |
| 5,800,134 | A | 9/1998 | Hasegawa et al. | |
| 5,960,875 | A | 10/1999 | Beauquin et al. | |
| 5,992,517 | A | 11/1999 | Mcanally | |
| 6,074,175 | A | 6/2000 | Hoshi et al. | |
| 6,155,792 | A | 12/2000 | Hartley et al. | |
| 6,602,059 | B1 | 8/2003 | Howell et al. | |
| 6,640,562 | B2 | 11/2003 | Odachi et al. | |
| 6,736,605 | B2 | 5/2004 | Ohashi et al. | |
| 7,001,157 | B2 | 2/2006 | Xiaoxi | |
| 7,316,270 | B2 | 1/2008 | Shen | |
| 7,413,009 | B2 | 8/2008 | Jacobs et al. | |
| 7,681,487 | B2 | 3/2010 | Galba | |
| 7,988,428 | B1 | 8/2011 | Macharg | |
| 9,663,993 | B2 | 5/2017 | Gajji et al. | |
| 10,030,490 | B2 | 7/2018 | Michel | |
| 2002/0035834 | A1 | 3/2002 | Cammack | |
| 2002/0104321 | A1 | 8/2002 | Odachi et al. | |
| 2002/0166700 | A1 | 11/2002 | Gillis et al. | |
| 2003/0044299 | A1 | 3/2003 | Thomas et al. | |
| 2003/0077183 | A1 | 4/2003 | Franchet et al. | |
| 2003/0145991 | A1 | 8/2003 | Olsen | |
| 2005/0011649 | A1 | 1/2005 | Stewart et al. | |
| 2005/0150224 | A1 * | 7/2005 | Hoffarth | F04B 47/08 60/533 |
| 2005/0220643 | A1 | 10/2005 | Honma et al. | |
| 2006/0013699 | A1 | 1/2006 | Lin et al. | |
| 2006/0283185 | A1 | 12/2006 | Wrona et al. | |
| 2007/0022751 | A1 | 2/2007 | Galba | |
| 2007/0196216 | A1 | 8/2007 | Almaraz | |
| 2008/0003118 | A1 | 1/2008 | Traylor et al. | |
| 2008/0080991 | A1 * | 4/2008 | Yuratich | F04B 43/10 417/390 |
| 2009/0000790 | A1 | 1/2009 | Bertane | |
| 2009/0041596 | A1 | 2/2009 | Ponomarev et al. | |
| 2009/0142207 | A1 | 6/2009 | Ring et al. | |
| 2010/0038959 | A1 | 2/2010 | Reuter et al. | |
| 2010/0083822 | A1 | 4/2010 | Shimizu | |
| 2010/0244595 | A1 | 9/2010 | Sheth | |
| 2011/0061873 | A1 | 3/2011 | Patterson et al. | |
| 2012/0034113 | A1 | 2/2012 | Porel | |
| 2012/0224977 | A1 | 9/2012 | Sotz et al. | |
| 2012/0224985 | A1 | 9/2012 | Forsberg | |
| 2013/0180730 | A1 | 7/2013 | Bebak et al. | |
| 2014/0014328 | A1 | 1/2014 | Groves | |
| 2014/0042835 | A1 | 2/2014 | Holzmueller et al. | |
| 2014/0105759 | A1 | 4/2014 | Henry et al. | |
| 2014/0174756 | A1 | 6/2014 | Sakamoto | |
| 2014/0341755 | A1 | 11/2014 | Laing et al. | |
| 2015/0260153 | A1 | 9/2015 | Kato et al. | |
| 2015/0300138 | A1 | 10/2015 | Michel | |
| 2015/0300330 | A1 | 10/2015 | Michel | |
| 2017/0184089 | A1 | 6/2017 | Reeves et al. | |
| 2018/0163718 | A1 | 6/2018 | Brown et al. | |

FOREIGN PATENT DOCUMENTS

| | | | |
|---|---|---|---|
| GB | 865648 | A | 4/1961 |
| GB | 2037364 | A | 7/1980 |
| GB | 2297568 | A | 8/1996 |
| WO | 9950524 | A2 | 10/1999 |
| WO | 2013024354 | A2 | 2/2013 |

* cited by examiner

LINEAR HYDRAULIC PUMP FOR SUBMERSIBLE APPLICATIONS

RELATED APPLICATIONS

This application is a divisional application of U.S. patent application Ser. No. 14/982,936 filed Dec. 29, 2015 entitled "Linear Hydraulic Pump for Submersible Applications," the disclosure of which is herein incorporated by reference.

FIELD OF THE INVENTION

This invention relates generally to the field of submersible pumping systems, and more particularly, but not by way of limitation, to a rotary hydraulic pump driven by a submersible electric motor.

BACKGROUND

Submersible pumping systems are often deployed into wells to recover petroleum fluids from subterranean reservoirs. Typically, a submersible pumping system includes a number of components, including an electric motor coupled to one or more centrifugal pump assemblies. Production tubing is connected to the pump assemblies to deliver the petroleum fluids from the subterranean reservoir to a storage facility on the surface. The pump assemblies often employ axially and centrifugally oriented multistage turbomachines.

In certain applications, however, the volume of fluid available to be produced from the well is insufficient to support the costs associated with conventional electric submersible pumping systems. In the past, alternative lift systems have been used to encourage production from "marginal" wells. Surface-based sucker rod pumps and gas-driven plunger lift systems have been used in low volume wells. Although widely adopted, these solutions may be unacceptable or undesirable for a number of reasons. In deviated wellbores, for example, sucker rod pumps tend to experience premature failure due to rod-on-tubing wear. There is, therefore, a need for an improved submersible pumping system that is well-suited for use in marginal or deviated wells.

SUMMARY OF THE INVENTION

The present invention includes a submersible pumping system that has an electric motor, a rotary hydraulic pump driven by the electric motor, and a linear hydraulic pump that is configured to move a production fluid. The rotary hydraulic pump produces a pressurized working fluid that drives the linear hydraulic pump.

In another aspect, a submersible pumping system disposed in a wellbore that includes an electric motor filled with a motor lubricant fluid, a hydraulic pump driven by the electric motor that increases the pressure of the motor lubricant fluid, and a production pump configured to produce a production fluid from the wellbore. The production pump is driven by the pressurized motor lubricant fluid.

In yet another aspect, a method for controlling the temperature of an electric motor within a submersible pumping system disposed in a wellbore begins with the step of providing an electric motor that is filled with motor lubricant fluid at a first temperature. Next, the electric motor is activated to drive a hydraulic pump. The method continues with the step of pumping the motor lubricant fluid with the hydraulic pump from the electric motor to a production pump. The production pump is driven by the motor lubricant fluid to evacuate a production fluid from the wellbore. The method concludes with the step of providing the return of the motor lubricant fluid from the production pump to the electric motor at second temperature that is lower than the first temperature.

WRITTEN DESCRIPTION

Figure 1:
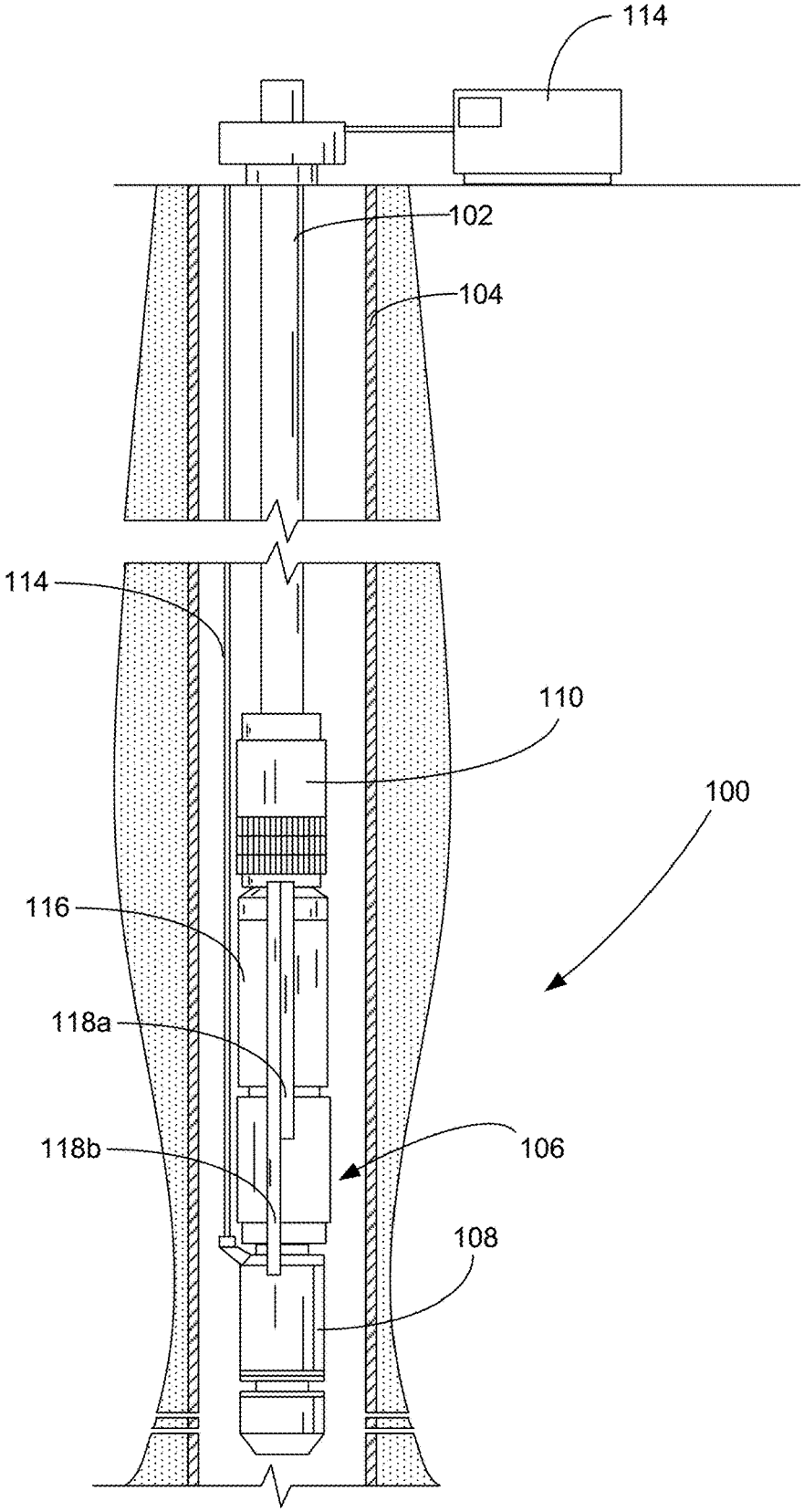
FIG. 1 depicts a submersible pumping system constructed in accordance with the present invention.

In accordance with an embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to surface-based equipment and facilities.

The pumping system 100 includes a hydraulic pump 106, a motor 108 and a production pump 110. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

As used in this disclosure, the terms "upstream" and "downstream" will be understood to refer to the relative positions within the pumping system 100 as defined by the movement of fluid through the pumping system 100 from the wellbore 104 to the surface. The term "longitudinal" will be understood to mean along the central axis running through the pumping system 100; the term "radial" will be understood to mean in directions perpendicular to the longitudinal axis; and the term "rotational" will refer to the position or movement of components rotating about the longitudinal axis.

The motor 108 is an electric submersible motor that receives power from a surface-based facility through a power cable 112. When electric power is supplied to the motor 108, the motor converts the electric power into rotational motion that is transferred along a shaft (not shown in FIG. 1) to the hydraulic pump 106. In some embodiments, the motor 108 is a three-phase motor that is controlled by a variable speed drive 114 located on the surface. The variable speed drive 114 can selectively control the speed, torque and other operating characteristics of the motor 108. The motor 108 may be filled with a dielectric motor lubricant fluid. The motor 108 can optionally be a permanent magnet motor.

The pumping system 100 optionally includes a seal section 116 positioned above the motor 108 and below the hydraulic pump 106. The seal section 116 shields the motor 108 from mechanical thrust produced by the hydraulic pump 106 and isolates the motor 108 from the wellbore fluids in the hydraulic pump 106. The seal section 116 may also be used to accommodate the expansion and contraction of the lubricants within the motor 108 during installation and operation of the pumping system 100. In alternative embodiments, the seal section 116 is incorporated within the motor 108 or within the hydraulic pump 106. Magnetic couplings may also be used to transfer torque between the motor 108, seal section 116 and hydraulic pump 106. The use of magnetic couplings obviates the need for shaft seals within the motor 108, seal section 116 and hydraulic pump 106.

Unlike prior art electric submersible pumping systems, the pumping system 100 moves fluids from the wellbore 104 to the surface using the production pump 110, which is powered by a working fluid that is pressurized by the hydraulic pump 106, which in turn is driven by the motor 108. Thus, the hydraulic pump 106 acts as a hydraulic generator and the production pump 110 acts as a production pump to evacuate fluids from the wellbore 104. High pressure working fluid line 118*a* is used to transfer working fluid between the hydraulic pump 106 and the production pump 110. High pressure working fluid line 118*b* is used to transfer working fluid from the production pump 110 back to the motor 108. The working fluid lines 118*a*, 118*b* may be internal to the components of the pumping system 100 or external (as depicted in FIG. 1).

The use of the hydraulic pump 106 to drive the production pump 110 presents several advantages over the prior art. In particular, the hydraulic pump 106 and motor 108 can be positioned in one portion of the wellbore 104, while the production pump 110 is located at a remote location. In some applications, it may be desirable to place the motor 108 and hydraulic pump 106 above the production pump 110, with the working fluid lines 118 extending through the wellbore between the hydraulic pump 106 and the production pump 110. The ability to divide the pumping system 100 into smaller distinct components connected by flexible lines permits the deployment of the pumping system 100 into highly deviated wellbores 104.

Figure 2:
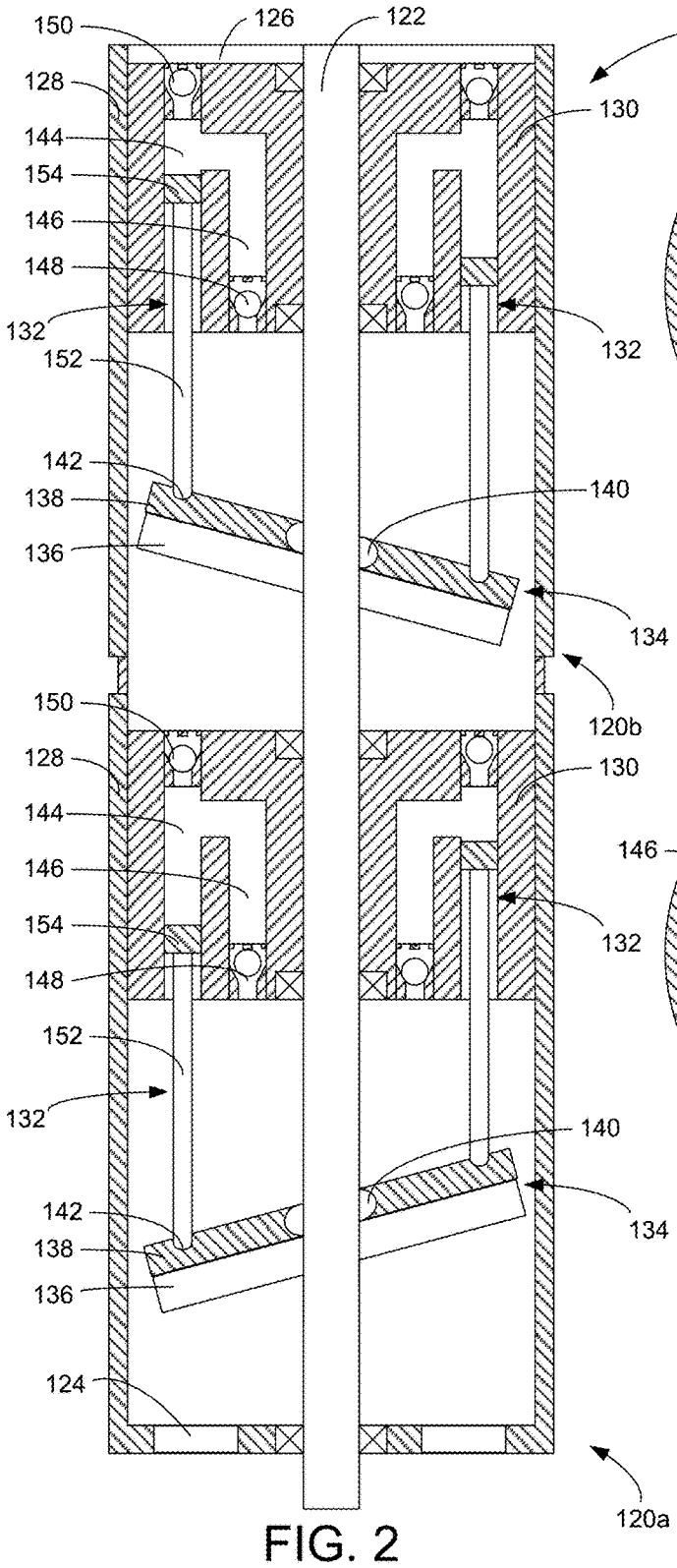
FIG. 2 provides a cross-sectional view of a rotary hydraulic pump of the pumping system of FIG. 1 constructed in accordance with a first embodiment.

In the embodiment depicted in FIG. 2, the hydraulic pump 106 utilizes a tilt-plate to translate the rotational movement of motor 108 into linearly reciprocating motion. In the cross-sectional depiction of the hydraulic pump 106 in FIG. 2, the hydraulic pump 106 includes an upstream chamber 120*a*, a downstream chamber 120*b* and a pump shaft 122. It will be appreciated, however, that the hydraulic pump 106 is not limited to two-chamber designs. The hydraulic pump 106 could alternatively include a single chamber or more than two chambers.

The hydraulic pump 106 further includes an intake 124, a discharge 126 and a housing 128. Each of the internal components within the hydraulic pump 106 is contained within the housing 128. The intake 124 is connected directly or indirectly to the motor 108 and the working fluid is the motor lubricant fluid. The use of the motor lubricant fluid as the working fluid has the benefit of cooling the motor lubricant fluid as it travels away from the motor 108 in a circuit through the hydraulic pump 106 and production pump 110. Alternatively, the intake 124 is connected to a working fluid reservoir (not shown in FIG. 2) that provides a supply of working fluid to the hydraulic pump 106. In yet another embodiment, the intake 124 can be configured to draw fluid from the wellbore 104 and use the wellbore fluid as the working fluid.

Generally, fluid enters the hydraulic pump 106 through the intake 124 and is carried by the upstream and downstream chambers 120*a*, 120*b* to the working fluid line 118*a* through the discharge 126. The pump shaft 122 is connected to the output shaft from the motor 108 (not shown) either directly or through a series of interconnected shafts. The hydraulic pump 106 may include one or more shaft seals that seal the shaft 122 as it passes through the upstream and downstream chambers 120*a*, 120*b*.

Figure 5:
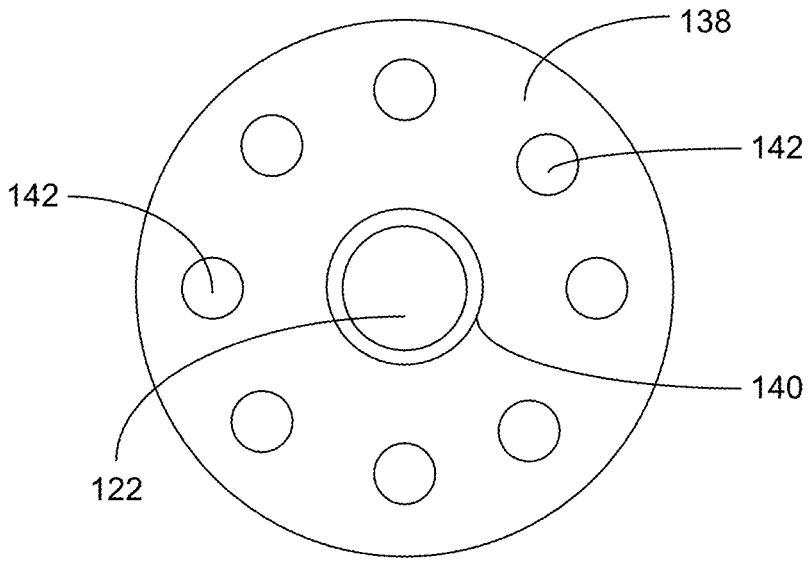
FIG. 5 is a view of the downstream side of the tilt plate of the rotary hydraulic pump of FIG. 2.
Figure 6:
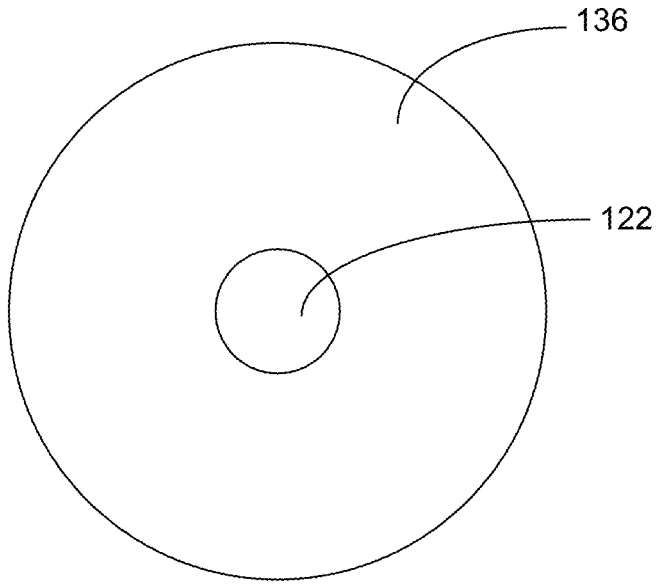
FIG. 6 is a view of the downstream side of the drive of the rotary hydraulic pump of FIG. 2.

Each of the upstream and downstream chambers 120*a*, 120*b* includes a cylinder block 130, one or more piston assemblies 132 and a tilt disc assembly 134. The tilt disc assembly 134 includes a drive plate 136 and a rocker plate 138. FIGS. 5 and 6 illustrate the upstream face of the rocker plate 138 and the upstream face of the drive plate 136. The rocker plate 138 and the drive plate 136 may both be formed as substantially cylindrical members.

Referring back to FIG. 2, the drive plate 136 is connected to the pump shaft 122 in a non-perpendicular orientation. In this way, rotation of the pump shaft 122 causes an upstream and a downstream edge of the drive plate 136 to rotate around the shaft 122 within the upstream and downstream chambers 118, 120 at opposite times. The drive plate 136 is connected to the pump shaft 122 at a fixed angle. In some embodiments, the angular disposition of the connection between the drive plate 136 and the pump shaft 122 can be adjusted during use.

The rocker plate 138 is not configured for rotation with the pump shaft 122 and remains rotationally fixed with respect to the cylinder block 130 and housing 128. In some embodiments, the upstream face of the rocker plate 138 is in sliding contact with the downstream face of the drive plate 136. In other embodiments, the hydraulic pump 106 includes a bearing between the rocker plate 138 and the drive plate 136 to reduce friction between the two components.

The rocker plate 138 includes a central bearing 140 and piston rod recesses 142. The central bearing 140 permits the rocker plate 138 to tilt in response to the rotation of the adjacent drive plate 136. Thus, as the drive plate 136 rotates with the pump shaft 122, the varying rotational position of the downstream edge of the drive plate 136 causes the rocker plate 138 to tilt in a rolling fashion while remaining radially aligned with the cylinder block 130 and housing 128. The central bearing 140 may include ball bearings, lip seals or other bearings that allow the rocker plate 138 to tilt in a longitudinal manner while remaining rotationally fixed.

Figure 3:
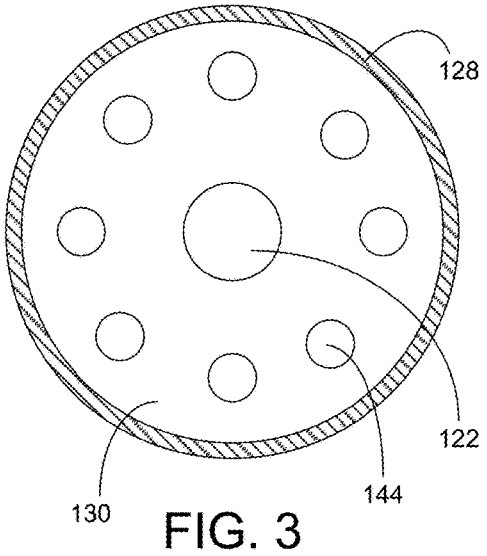
FIG. 3 is a view of the downstream side of the cylinder block of the rotary hydraulic pump of FIG. 2.
Figure 4:
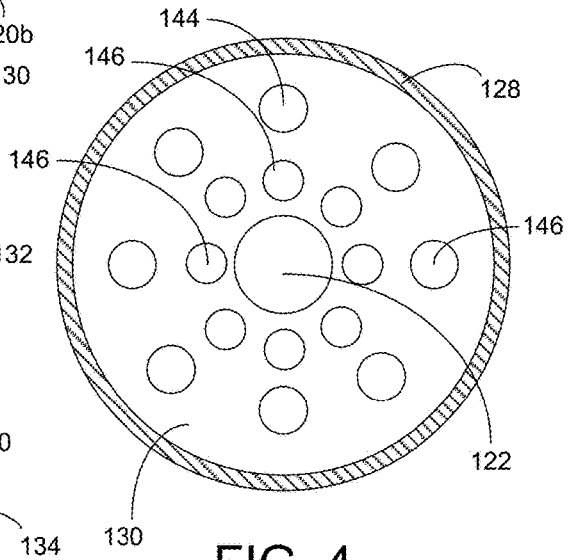
FIG. 4 is a view of the upstream side of the cylinder block of the rotary hydraulic pump of FIG. 2.

Referring now to FIGS. 2, 3 and 4, the cylinder block 130 is fixed within the housing 128. The cylinder block 130 includes a plurality of cylinders 144, intake ports 146 and one-way valves 148. In the embodiment depicted in FIGS. 3 and 4, the cylinder block 130 includes six cylinders 144, six intake ports 146, six intake way valves 148 and six discharge valves 150. It will be understood, however, that the scope of the embodiments is not limited to a particular number of cylinders 144, intake ports 146 and one-way valves 148.

The piston assemblies 132 include a piston rod 152 and a plunger 154. In the embodiment depicted in FIG. 3, the hydraulic pump 106 includes six piston assemblies 132. It will be understood, however, that the scope of the embodiments is not limited to a particular number of piston assemblies 132. A proximal end of each the piston rods 152 is secured within a corresponding one of the piston rod recesses 142 in the rocker plate 138. A distal end of each of the piston rods 152 is attached to the plunger 154. Each plunger 154 resides within a corresponding one of the cylinders 144.

In the embodiment depicted in FIG. 3, the intake ports 146 extend to the upstream side of the cylinder blocks 130. An intake valve 148 within the intake ports 146 allows fluid to enter the intake port 146 from the upstream side of the cylinder block 130, but prohibits fluid from passing back out of the upstream side of the cylinder block 130. A corresponding discharge valve 150 allows fluid to exit the cylinder 144, but prohibits fluid from entering the cylinder 144.

Figure 7:
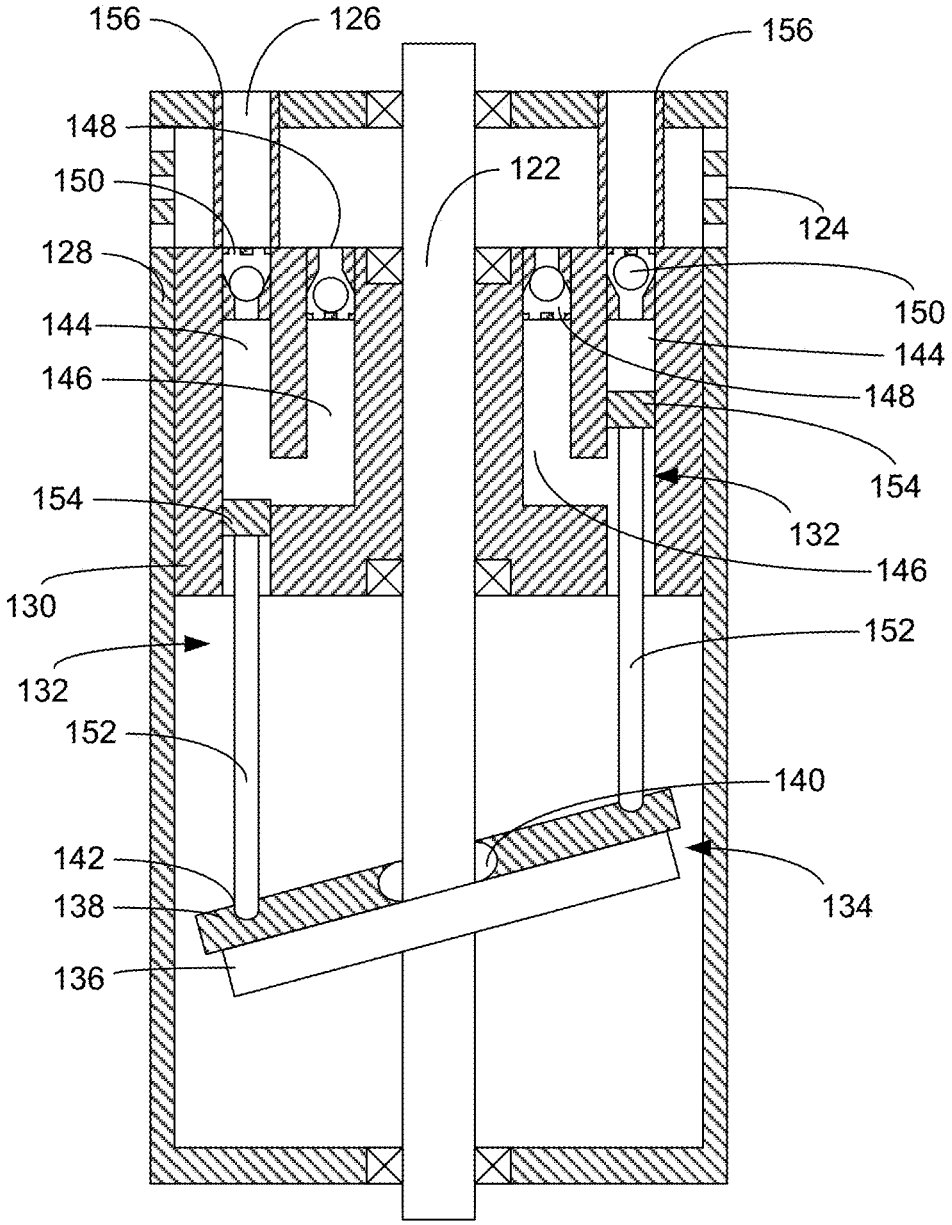
FIG. 7 provides a cross-sectional view of a rotary hydraulic pump constructed in accordance with a second embodiment.

In the embodiment depicted in FIG. 7, the intake ports 146 extend through the downstream side of a single cylinder block 130. An intake valve 148 within the intake ports 146 allows fluid to enter the intake port 146 from the downstream side of the cylinder block 130, but prohibits fluid from passing back out of the intake port 146. A corresponding discharge valve 150 allows fluid to exit the cylinder 144, but prohibits fluid from entering the cylinder 144. In the embodiment depicted in FIG. 7, it may be desirable to attach discharge tubes 156 to each of the cylinders 144 to prevent fluid from recirculating through the cylinder block 130.

During operation, the motor 108 turns the pump shaft 122, which in turn rotates the drive plate 136. As the drive plate 136 rotates, it imparts reciprocating longitudinal motion to the rocker plate 136. With each complete rotation of the drive plate 136, the rocker plate 138 undergoes a full cycle of reciprocating, linear motion. The linear, reciprocating motion of the rocker plate 138 is transferred to the plungers 154 through the piston rods 152. The piston rods 152 force the plungers 154 to move back and forth within the cylinders 144.

As the plungers 154 move in the upstream direction, fluid is drawn into the cylinders through the intake ports 146 and intake valves 148. As the plungers 154 continue to reciprocate and move in the downstream direction, the intake valves 148 close and fluid is forced out of the cylinders 144 through the discharge valves 150. In this way, the stroke of the piston assemblies 132 is controlled by the longitudinal distance between the upstream and downstream edges of the rocker plate 138. The rate at which the piston assemblies 132 reciprocate within the cylinder block 130 is controlled by the rotational speed of the motor 108 and pump shaft 122.

Figure 8:
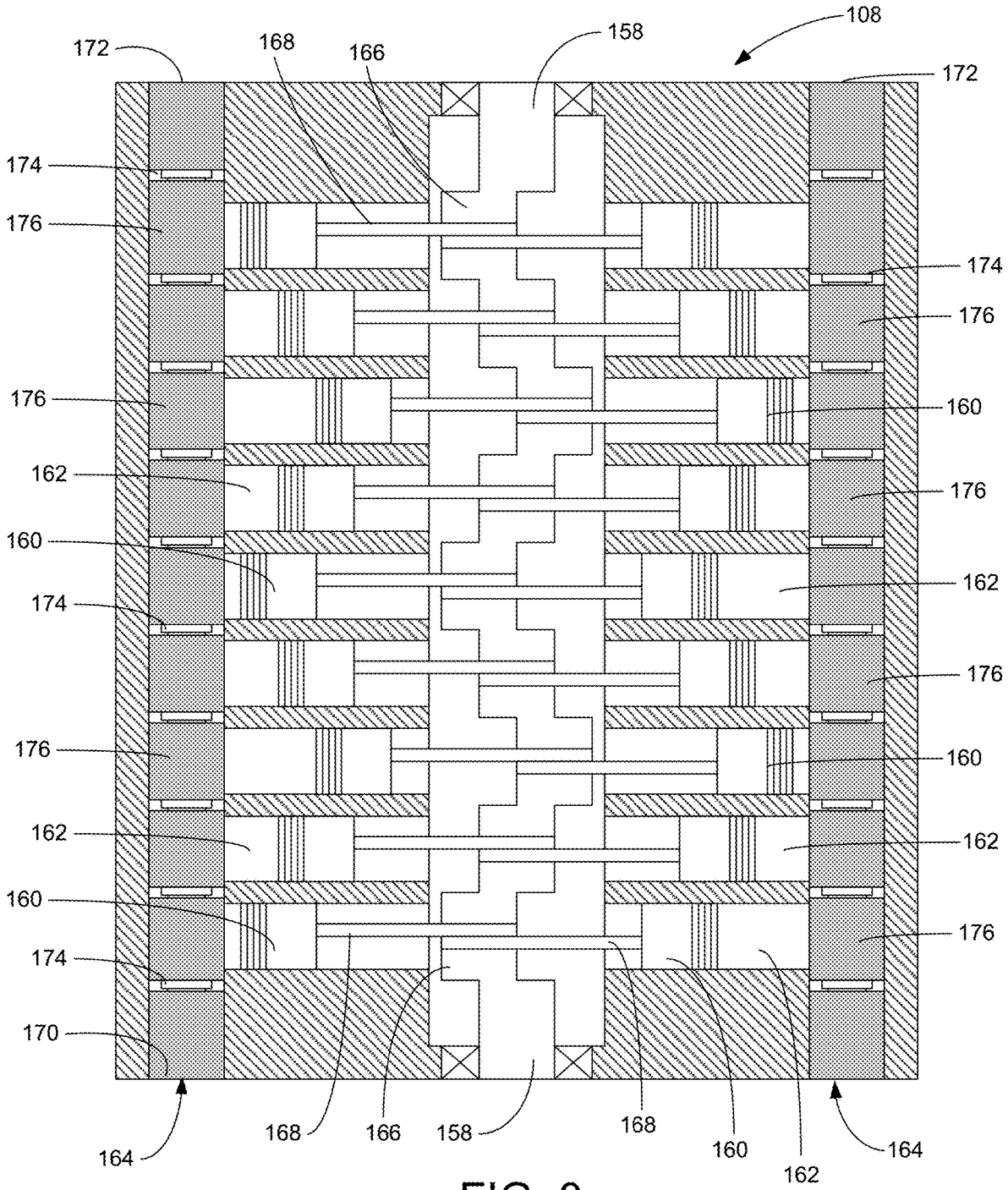
FIG. 8 provides a side cross-sectional view of a rotary hydraulic pump of the pumping system of FIG. 1 constructed in accordance with another embodiment.
Figure 9:
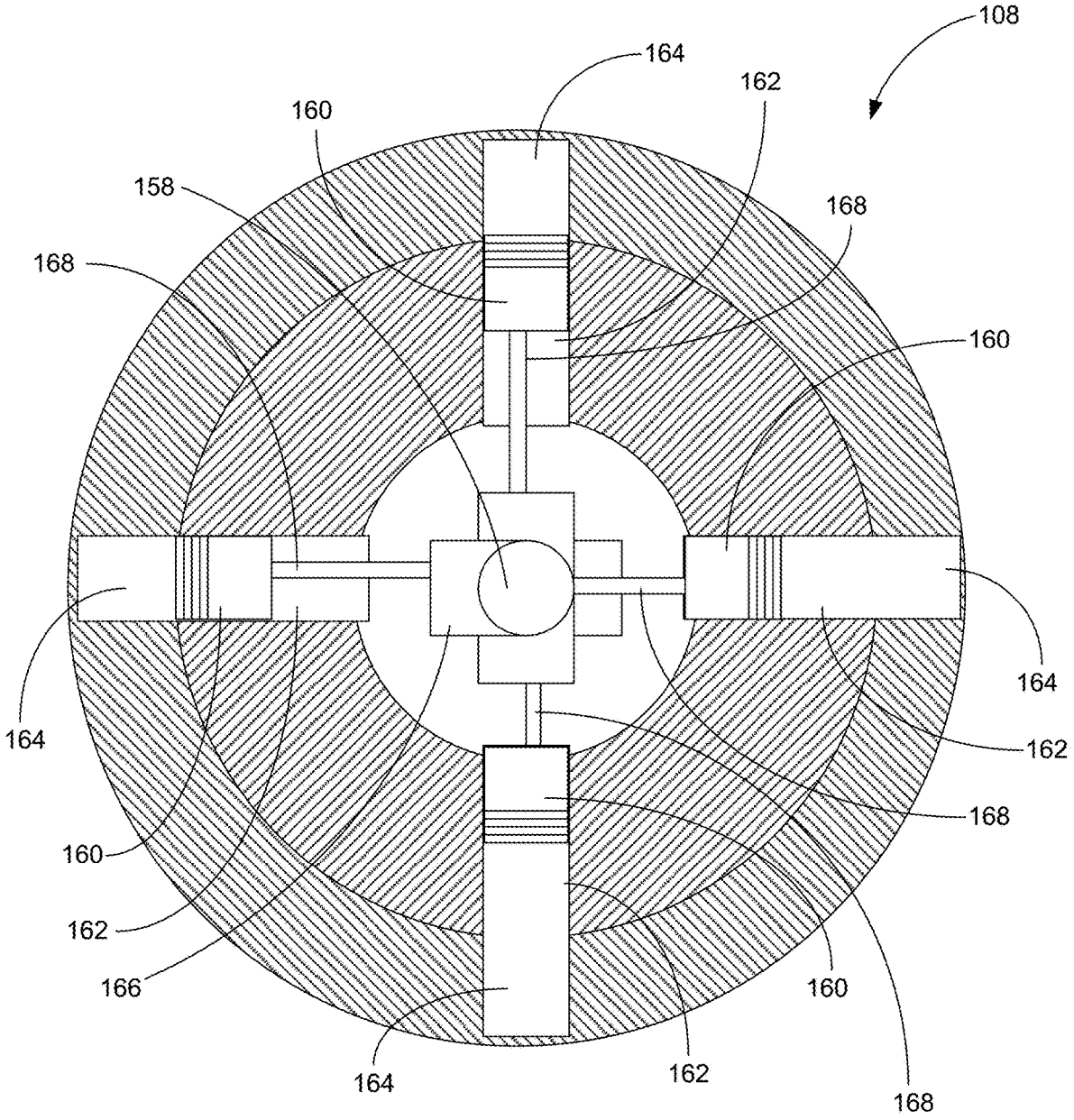
FIG. 9 provides a top cross-sectional depiction of the rotary hydraulic pump of FIG. 8.

Turning to FIG. 8, shown therein is a cross-sectional depiction of the hydraulic pump 106 constructed in accordance with a second embodiment. In the embodiment depicted in FIG. 8, the hydraulic pump 106 uses a central camshaft 158 to drive one or more series of pistons 160 within banks of cylinders 162. The cylinders 162 are connected to manifolds 164 that extend the length of the hydraulic pump 106. The manifolds 164 are in fluid communication with the intake 124 and the working fluid lines 118. The hydraulic pump 106 may include 2, 4, 6 or 8 banks of cylinders 162, manifolds 164 and series of pistons 160 that are equally distributed around the hydraulic pump 106, as depicted in the top cross-sectional view of FIG. 9.

The camshaft 158 includes a number of radially offset lobes 166 to which connecting rods 168 are secured for rotation. The camshaft 158 is connected directly or indirectly to the output shaft from the motor 108 such that operation of the motor 108 causes the camshaft 158 to rotate at the desired speed. It will be appreciated that the pistons 160, camshaft 158 and connecting rods 168 may include additional features not shown or described that are known in the art, including for example, wrist pins, piston seal rings and piston skirts. Each set of pistons 160 and connecting rods 168 can be collectively referred to as a "piston assembly" within the description of this embodiment.

Each of the manifolds 164 includes an inlet 170 and outlet 172 and one or more check valves 174. The inlets 170 are connected to the pump intake 124 and the outlets 172 are connected to the discharge 126. In the embodiment depicted in FIG. 8, each manifold 164 includes a separate check valve between adjacent pistons 160. The check valves 174 prevent fluid from moving upstream in a direction from the outlet 172 to the inlet 170. In this way, the check valves 174 separate the manifolds 164 into separate stages 176 that correlate to each of the pistons 160 and cylinders 162.

During operation, the camshaft 158 rotates and causes the pistons 160 to move in reciprocating linear motion in accordance with well-known mechanics. As a piston 160 retracts from the manifold 164, a temporary reduction in pressure occurs within the portion of the manifold 164 adjacent to the cylinder 162 of the retracting piston 160. The reduction in pressure creates a suction that draws fluid into the stage 176 from the adjacent upstream stage 176 through the intervening check valve 174.

During a compression stroke, the piston 160 moves through the cylinder 162 toward the manifold 164, thereby reducing the volume of the open portion of the cylinder 162 and stage 176. As the pressure increases within the stage 176 adjacent the piston 160 in a compression stroke, fluid is discharged to the adjacent downstream stage through the check valve 174. The configuration and timing of the camshaft 158 can be optimized to produce suction-compression cycles within each stage 176 that are partially or totally offset between adjacent stages 176 that provide for the sequential stepped movement of fluid through the manifolds 164.

Alternatively, the pistons 160 can be configured to extend into the manifold 164. In yet another alternate embodiment, the check valves 174 are omitted and the progression of fluid through the manifold 164 is made possible by holding the pistons 160 in a closed position within the manifold 164 to act as a stop against the reverse movement of fluid toward the inlet 170. The timing of the pistons 160 can be controlled using lobed cams and rocker arms as an alternative to the camshaft 158 and connecting rods 168. In this way, the pistons 160 produce rolling progressive cavities within the manifolds 164 that push fluid downstream through the hydraulic pump 106. Other forms of positive displacement pumps may be used as the hydraulic pump 106, including rotary positive displacement pumps that include rotating and variable chambers.

Figure 10:
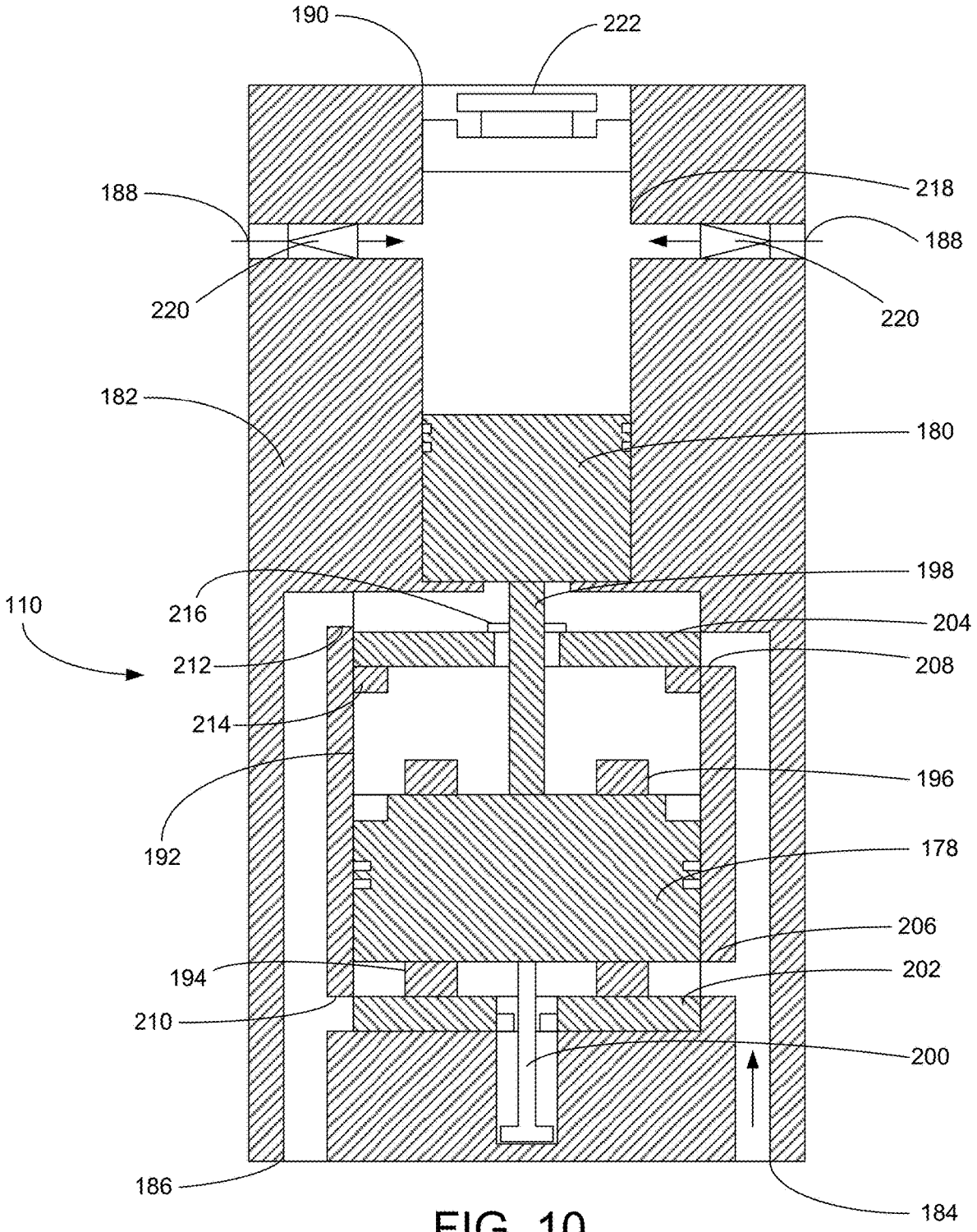
FIG. 10 is a cross-sectional view of the production pump in a first position.

Turning to FIG. 10, shown therein is a cross-sectional view of an exemplary embodiment of the production pump 110 at the beginning of a stroke. As shown in FIG. 10, the production pump 110 includes a master piston 178 driven by the pressurized working fluid that is connected to a slave piston 180 that forces fluid from the wellbore 104 into the production tubing 102 (not shown). The production pump 110 includes a body 182 that has a working fluid inlet 184, a working fluid return 186, one or more production fluid intakes 188 and a production fluid discharge 190.

The master piston 178 reciprocates in a master cylinder 192 that is in fluid communication with the working fluid inlet 184 and working fluid return 186. The master piston 178 includes lower standoffs 194, upper standoffs 196, a pushrod 198 connected to the slave piston 180 and a pull rod 200. The production pump 110 also includes a lower valve plate 202 and an upper valve plate 204. The pull rod 200 is configured to lift the lower valve plate 202 during upward movement of the master cylinder 192. A valve control ring 206 attached to the pushrod 198 is configured to lower the upper valve plate 204 during downward movement of the master cylinder 192.

Fluid is alternately admitted to the master cylinder 192 through a lower injection port 206 and an upper injection port 208 that are both in fluid communication with the working fluid inlet 184. Fluid is alternately evacuated from the master cylinder 192 through upper vent 212 and lower vent 210. The admittance and evacuation of working fluid is controlled by the position of the lower valve plate 202 and upper valve plate 204. In the first position shown in FIG. 10, the lower valve plate 202 rests on the bottom of the master cylinder 192 and allows pressurized working fluid to enter into the master cylinder 192 through lower injection port 206. The lower valve plate 202 blocks the lower vent 212 in this first position. The upper valve plate 204 rests of a ring flange 214 within the master cylinder 192 in the first position and blocks the upper injection port 208 and allows fluid to pass through the upper valve plate 204 and out the upper vent 212.

Figure 11:
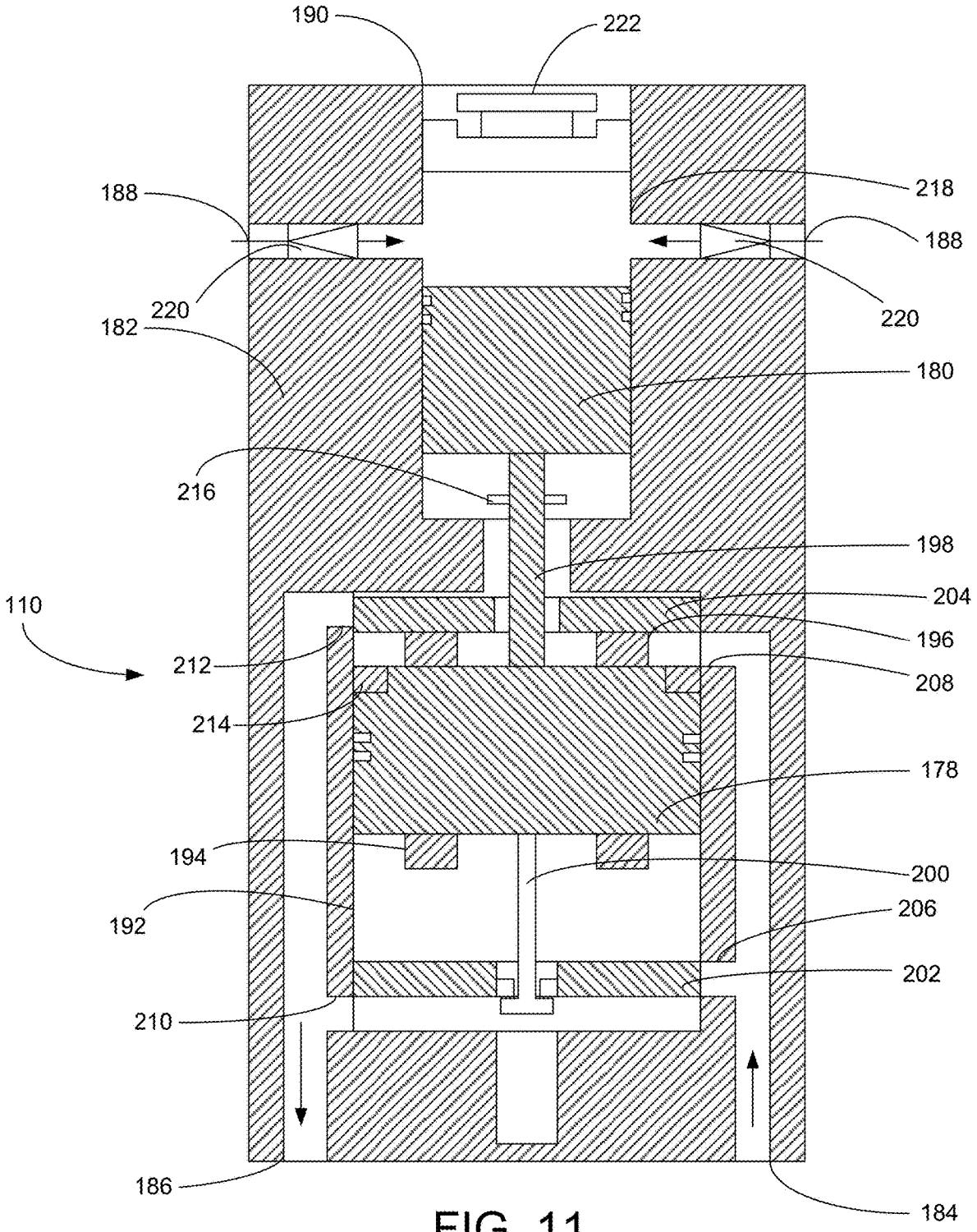
FIG. 11 is a cross-sectional view of the production pump of FIG. 10 in a second position.

As pressure builds in the master cylinder 192 below the master piston 178, the master piston 178 rises. When the master piston 178 nears the completion of its upward stroke, the pull rod 200 catches the lower valve plate 202 and raises the lower valve plate to a second position in which the lower injection port 206 is blocked and the lower vent 210 is opened, as depicted in FIG. 11. At the same time, the upper standoffs 196 push the upper valve plate 204 into a position in which the upper vent 212 is blocked and the upper injection port 208 is opened. This allows pressurized working fluid to enter the master cylinder 192 through the upper injection port 208 and exit the master cylinder 192 through the lower vent 210. As the pressure builds above the master piston 178, the master piston 178 is forced downward. As the master piston 178 nears the end of the downward stroke, the lower standoffs 194 press the lower valve plate 202 into the first position in preparation for a subsequent cycle (as depicted in FIG. 10). At the same time, a valve control ring 216 connected to the pushrod 198 pulls the upper valve plate 204 back into the first position (as depicted in FIG. 10). Thus, the master piston 178 reciprocates back and forth within the master cylinder 192.

As the master piston 178 reciprocates, the slave piston 180 likewise reciprocates within a slave cylinder 218. The slave cylinder 218 is in fluid communication with the production fluid intakes 188. When the slave piston 180 is retracted (as shown in FIG. 10), production fluid from the wellbore 104 passes through the production fluid intake 188 into the slave cylinder 218. The production fluid intakes 188 include one-way valves 220 that prevent the movement of fluid out of the slave cylinder 218 through the fluid intakes 188. During a compression stroke, the slave piston 180 forces the production fluid out of the slave cylinder 218 into the production tubing 202 through the production fluid discharge 190. The slave cylinder 218 optionally includes a discharge check valve 222 that prevents production fluid from passing back into the slave cylinder 218 from the production tubing 102.

In this way, the production pump 110 depicted in FIGS. 10 and 11 provides a hydraulically-driven, single-acting reciprocating pump that is well-suited to evacuate production fluid from the wellbore 104. It will be appreciated that the production pump 110 of FIGS. 10 and 11 may alternatively be configured as a double-acting pump that produces fluid during both phases of the reciprocating stroke.

Figure 12:
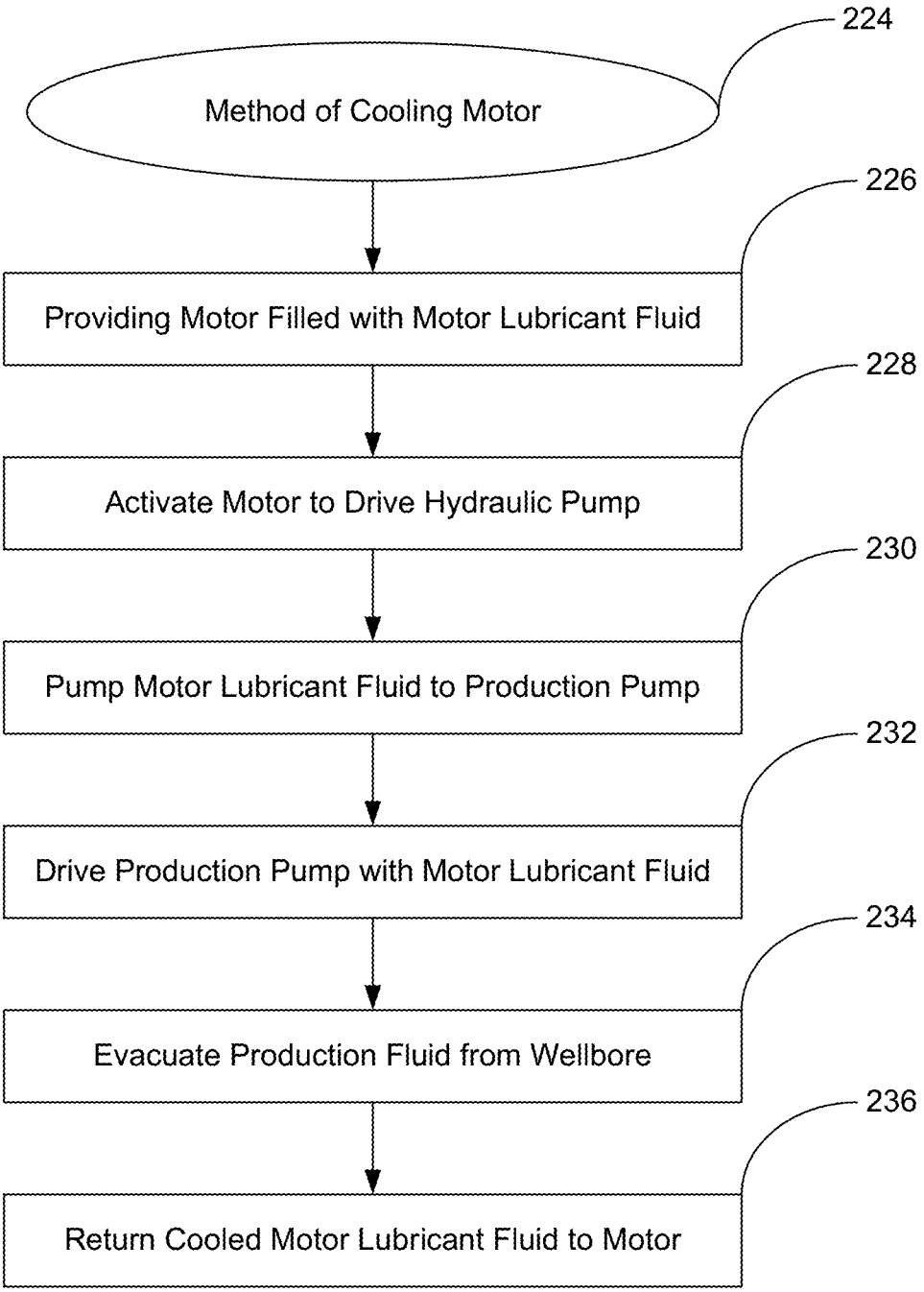
FIG. 12 is a process flow diagram depicting a method of cooling motor lubricant fluid.

In yet another aspect, some embodiments include a method 224 for controlling the temperature of the electric motor 108. Turning to FIG. 12, the method 224 begins with the step 226 of providing the electric motor 108 that is filled with motor lubricant fluid at a first temperature. Next, at step 228, the electric motor 108 is activated to drive the hydraulic pump 106. The method continues at step 230 with the hydraulic pump 106 pumping the motor lubricant fluid from the electric motor 108 to the production pump 110. At step 232, the production pump 110 is driven by the motor lubricant fluid. At step 234, the production pump 110 is used to evacuate production fluid from the wellbore 104. During the operation of the production pump 110, the motor lubricant fluid is cooled to a second temperature. The method 210 concludes with step 236 by providing the return of the motor lubricant fluid from the production pump 110 to the electric motor 108 at a second temperature that is lower than the first temperature.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A submersible pumping system disposed in a wellbore, the submersible pumping system comprising:

an electric motor, wherein the electric motor is filled with a motor lubricant fluid;

a hydraulic pump driven by the electric motor, wherein the hydraulic pump increases the pressure of the motor lubricant fluid and wherein the hydraulic pump comprises:

a rotatable pump shaft driven the electric motor;

a camshaft connected to the rotatable pump shaft, wherein the camshaft includes a plurality of radially offset lobes spaced apart along the camshaft;

a plurality of cylinder banks, wherein each of the plurality of cylinder banks includes a plurality of cylinders;

a plurality of series of pistons, wherein each of the plurality of series of pistons comprises a plurality of individual linearly reciprocating pistons, wherein all of the individual linearly reciprocating pistons within a corresponding one of the plurality of series of pistons are connected to the same radially offset lobe on the camshaft and are contained within cylinders within a corresponding one of the plurality of cylinder banks; and a plurality of manifolds, wherein each of the plurality of manifolds includes a plurality of stages, wherein each of the plurality of stages is adjacent to a separate one of the plurality of cylinder banks; and a production pump configured to produce a production fluid from the wellbore, wherein the production is driven by the pressurized motor lubricant fluid.

2. The submersible pumping system of claim 1, wherein the production pump comprises:

a master cylinder in fluid communication with the pressurized motor lubricant fluid;

a master piston configured for linear reciprocating movement within the master cylinder;

a slave cylinder in fluid communication with the production fluid; and a slave piston within the slave cylinder, wherein the slave piston moves in response to the movement of the master piston.

3. The submersible pumping system of claim 2, wherein the production pump further comprises:

upper and lower injection ports in fluid communication with the master cylinder;

upper and lower vents in fluid communication with the master cylinder;

a lower valve plate, wherein the lower plate is movable and configured to block either the lower vent or the lower injection port depending on the position of the upper valve plate; and an upper valve plate, wherein the upper valve plate is movable and configured to block either the upper vent or the upper injection port depending on the position of the upper valve plate.

4. The submersible pumping system of claim 3, wherein the production pump further comprises a pushrod connected between the master piston and the slave piston.

5. The submersible pumping system of claim 4, wherein the master piston includes a valve control ring on the push rod that is configured to push down the upper valve plate during a downward stroke of the master piston.

6. The submersible pumping system of claim 4, wherein the master piston includes a pull rod that is configured to lift the lower valve plate during an upward stroke of the master piston.

7. The submersible pumping system of claim 3, wherein the master piston includes lower standoffs that are configured to push the lower valve plate downward during a downward stroke of the master piston.

8. The submersible pumping system of claim 3, wherein the master piston includes upper standoffs that are configured to push the upper valve plate upward during an upward stroke of the master piston.

9. The submersible pumping system of claim 1, wherein each of the plurality of manifolds includes a plurality of check valves and wherein each of the plurality of check valves is located between adjacent ones of the plurality of cylinder banks.

10. The submersible pumping system of claim 1, wherein each of the plurality of pistons is configured to extend into the corresponding stage of the plurality of stages within the corresponding one of the plurality of manifolds.

* * * * *